United States Patent [19]

Falconieri et al.

[11] Patent Number: 5,007,749

[45] Date of Patent: Apr. 16, 1991

[54] CARTRIDGE INCLUDING TENSION MEANS FOR A TYPEWRITER CORRECTION RIBBON

[75] Inventors: Remo Falconieri, S. Giorgio; Sergio Uggetti, Ivrea, both of Italy

[73] Assignee: Ing. C. Olivetti & C., S.p.A., Ivrea, Italy

[21] Appl. No.: 343,825

[22] Filed: Apr. 25, 1989

[30] Foreign Application Priority Data

May 9, 1988 [IT] Italy ..... 67425 A/88

[51] Int. Cl.[5] ..... B41J 35/28

[52] U.S. Cl. ..... 400/208; 400/234; 400/236

[58] Field of Search ..... 400/194, 195, 196, 196.1, 400/207, 208, 208.1, 234, 236, 236.1, 695, 696, 697, 697.1

[56] References Cited

U.S. PATENT DOCUMENTS

| | | | |
|---|---|---|---|
| 3,442,366 | 5/1969 | Spears | 400/234 |
| 3,877,561 | 4/1975 | Guerrini et al. | 400/208 |
| 4,074,799 | 2/1978 | Hishida et al. | 400/208 |
| 4,247,210 | 1/1981 | Kachmarcik et al. | 400/208 X |
| 4,329,072 | 5/1982 | Kacmarcik | 400/212 X |
| 4,347,008 | 8/1982 | Jagodzinski et al. | 400/208 |
| 4,368,992 | 1/1983 | Gagnebin | 400/196 |
| 4,373,824 | 2/1983 | Olsen | 400/234 |
| 4,401,394 | 8/1983 | Hume et al. | 400/234 |
| 4,402,621 | 9/1983 | Abell, Jr. et al. | 400/208 |
| 4,544,291 | 10/1985 | Nagata et al. | 400/234 X |
| 4,605,327 | 8/1986 | Ueki et al. | 400/234 X |
| 4,637,744 | 1/1987 | Valle et al. | 400/208 X |
| 4,710,044 | 12/1987 | Ackermann | 400/234 X |
| 4,747,716 | 5/1988 | Van Der Eikel | 400/234 X |
| 4,790,677 | 12/1988 | Kress | 400/234 X |
| 4,804,283 | 2/1989 | Imai | 400/696 X |

FOREIGN PATENT DOCUMENTS

| | | | |
|---|---|---|---|
| 0042955 | 1/1982 | European Pat. Off. | 400/208 |

*Primary Examiner*—Edgar S. Burr
*Assistant Examiner*—Ren Yan
*Attorney, Agent, or Firm*—Banner, Birch, McKie & Beckett

[57] ABSTRACT

A cartridge for a correction ribbon for typewriters comprises a container for a supply reel and a receiving reel. A tensioning device comprises a toothed ring on the supply rell and a spring which is pivoted in the container and which has one end engaged with the toothed ring to tension the ribbon. The container can be removably fixed to the lower part of a cartridge for a typing ribbon which in turn can be fitted on a support of the machine. The support is movable from a viewing position to a typing position in which the typing ribbon is in front of the point of typing and to a correction position in which the correction ribbon is in front of the point of typing. The receiving reel of the cartridge, in use, is capable of co-operating with a feed mechanism which provides for forward feed movement of the ribbon in each correction cycle. For that purpose the receiving reel comprises a series of frontal teeth provided in the lower part of its flange, the container comprises an opening and the feed mechanism comprises a ratchet co-operating with the frontal teeth through the opening for a forward feed cycle of the correction ribbon when the support moves between the viewing position and the correction position.

18 Claims, 3 Drawing Sheets

CARTRIDGE INCLUDING TENSION MEANS FOR A TYPEWRITER CORRECTION RIBBON

CROSS-REFERENCES TO RELATED APPLICATIONS

Italian No. 67132 - A/88.

BACKGROUND OF THE INVENTION (1) Field of the Invention

The present invention relates to a cartridge for a correction ribbon for typewriters with supply and receiving reels for the ribbon in a container. The receiving reel co-operates with a feed mechanism on the typewriter to feed the ribbon.

(2) Description of the Prior Art

EP-A No. 0 042 955 discloses a cartridge in which the supply reel co-operates with a two-armed spring having a central portion which is of an omega-like shape, making frictional engagement with the hub portion of the reel. One of the two arms has its end fixed to the cartridge and the second arm has an end which co-opertes with the ribbon which is unwound from the reel, with a tensioning function. In each correction cycle the ribbon is caused to advance and the tension of the ribbon causes rotary movement of the second arm, which slightly opens the central part of the spring. The reel is thus free to rotate, permitting the ribbon to unwind. This tensioning device suffers from the disadvantage that, in successive correction cycles, the reel can unwind more turns of ribbon because of the vibration due to the movement of the carriage. In that situation the second arm fails to perform its function of tensioning the ribbon, giving rise to imperfect correction.

EP-A No. 0 021 737 also discloses a tensioning device for a correction ribbon, which provides a toothed ring in the lower part of the supply reel and a slider which is slidable in a guide slot tangentially to the toothed ring and is provided with a pair of teeth capable of engagement with and disengagement from the toothed ring. The slider is spring-loaded in such a way that the feed movement of the ribbon is resisted by the action of the slider on the toothed ring until disengagement of the teeth thereof from the toothed ring. That device is not suitable for use in cartridges for correction ribbons of reduced dimensions.

EP-A No. 0 195 125 discloses a cartridge for a correction ribbon which can be mounted on an oscillating support of the machine. The cartridge is actuated by a feed mechanism which provides a ratchet supported by the container of the cartridge and which normally engages the peripheral teeth on the receiving reel. The ratchet is provided with a control peg which projects from the container and is engaged in a seat of an actuator of the feed mechanism of the machine. In each correction cycle the mechanism is actuated by the oscillating movement of the support for moving the actuator thereof, rotating the reel and thus producing unidirectional feed movement of the correction ribbon. This cartridge is rather complicated. In addition it suffers from the disadvanage that, upon replacement thereof, the operator is required to achieve a high degree of accuracy in positioning the control peg of the ratchet on the seat configuration of the actuator of the feed mechanism of the machine in order to be able to produce correct feed movement of the ribbon in the correction cycles thereof.

SUMMARY OF THE INVENTION

The object of the present invention is to provide a cartridge for a correction ribbon which is simple and reliable.

Another object is to provide a cartridge which is of small dimensions and low cost.

A further object is to optimize tensioning and forward feed movement of the correction ribbon.

The above-described objects are met by the cartridge for a correction ribbon according to the invention. The cartridge has a tensioning device which comprises a toothed ring having a series of peripheral teeth and is integral with the supply reel. A spring element has a fixed part bearing against the container and a yielding part having an end engaged with the teeth of the toothed ring. The spring urges the supply reel in the opposite direction to unwinding of the correction ribbon for tensioning the ribbon. The end of the spring element is capable of being intermittently disengaged from the said teeth during the feed movement of the ribbon and being held in engagement with one of the teeth for a given operating travel in which it applies the tensioning action to the supply reel.

The cartridge of the invention also has improvements in regard to the parts which provide for the forward feed movement of the correction ribbon.

The container of the correction cartridge is removably fixed on the lower part of another cartridge for a typing ribbon which in turn can be mounted on a support of the typewriter. The support is movable selectively from a viewing position, in which the point of typing is visible, to a typing position in which the typing ribbon is in front of the point of typing and a correction position in which the correction ribbon is in front of the point of typing. The receiving reel is actuated by a feed mechanism of the machine, which is responsive to the displacement of the support about the correction position to produce undirectional feed movement of the ribbon in each correction cycle.

The correction cartridge moreover comprises a series of frontal teeth provided in the lower part of a flange of the receiving reel and an opening in the bottom of the container in alignment with a given part of the series of frontal teeth. The cartridge can be used in typewriters in which the feed mechanism comprises a ratchet pivoted on a fixed support and having a terminal tooth capable of co-operating with the frontal teeth through the opening in the bottom of the container. A spring element applies to the ratchet a thrust force in a predetermined direction towards the flange. This thrust force can be resisted by a movement for mounting of the cartridge on the movable support of the machine.

BRIEF DESCRIPTION OF THE DRAWINGS

The following description sets forth a preferred embodiment of the invention which is given by way of non-limiting example with reference to the accompanying drawings in which.

DESCRIPTION OF THE PREFERRED EMBODIMENT

Figure 1:
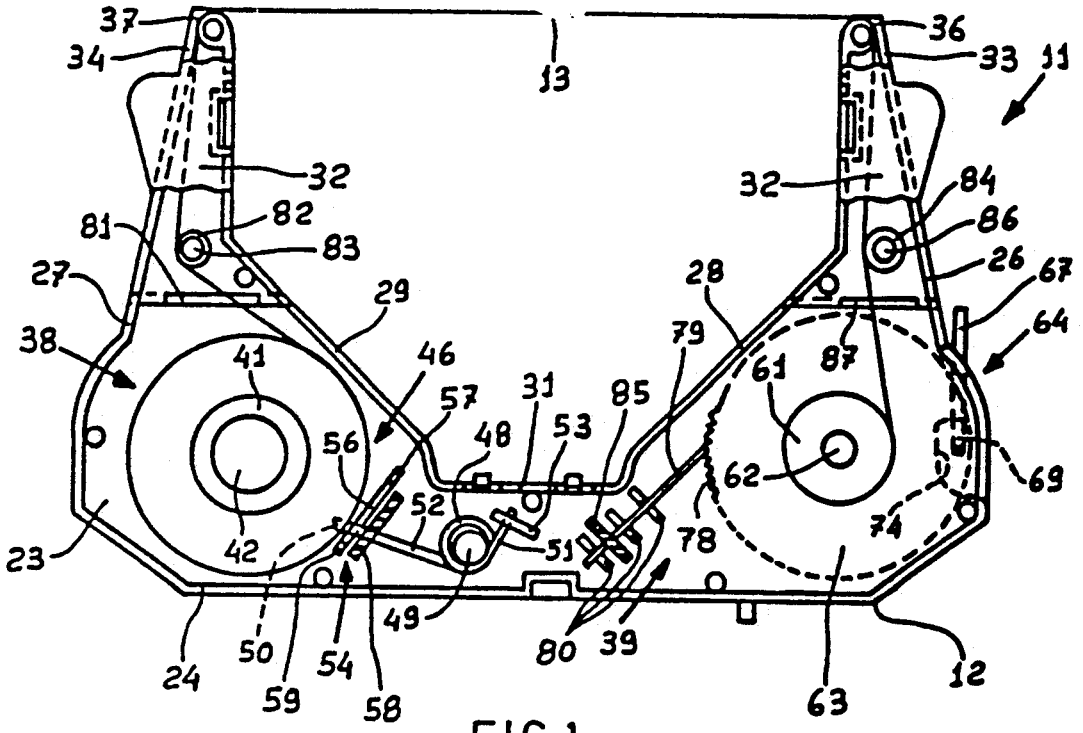
FIG. 1 is a plan view of part of a cartridge according to the invention.
Figure 5:
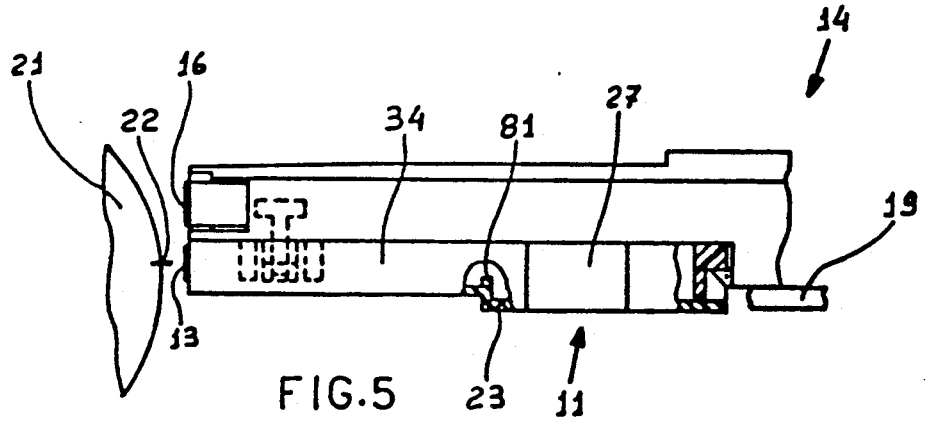
FIG. 5 shows a side view of part of the structure shown in FIG. 4, illustrating some features thereof, in another operating position.
Figure 4:
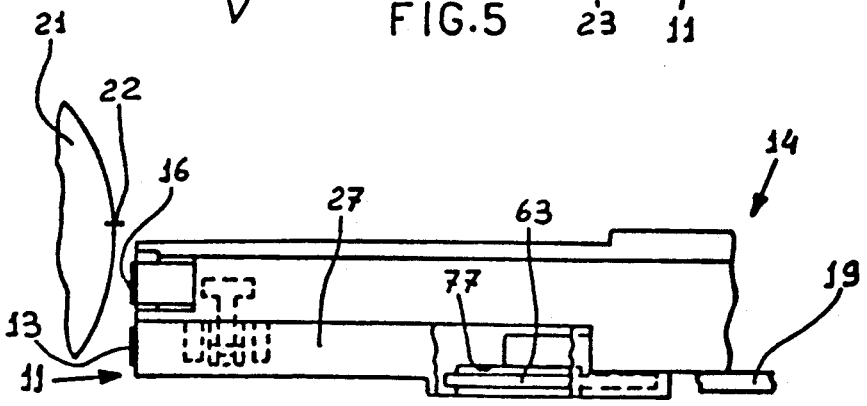
FIG. 4 is a side view of part of the cartridge shown in FIG. 1 and a cartridge for a typing ribbon mounted on a typewriter in an operating position.
Figure 2:
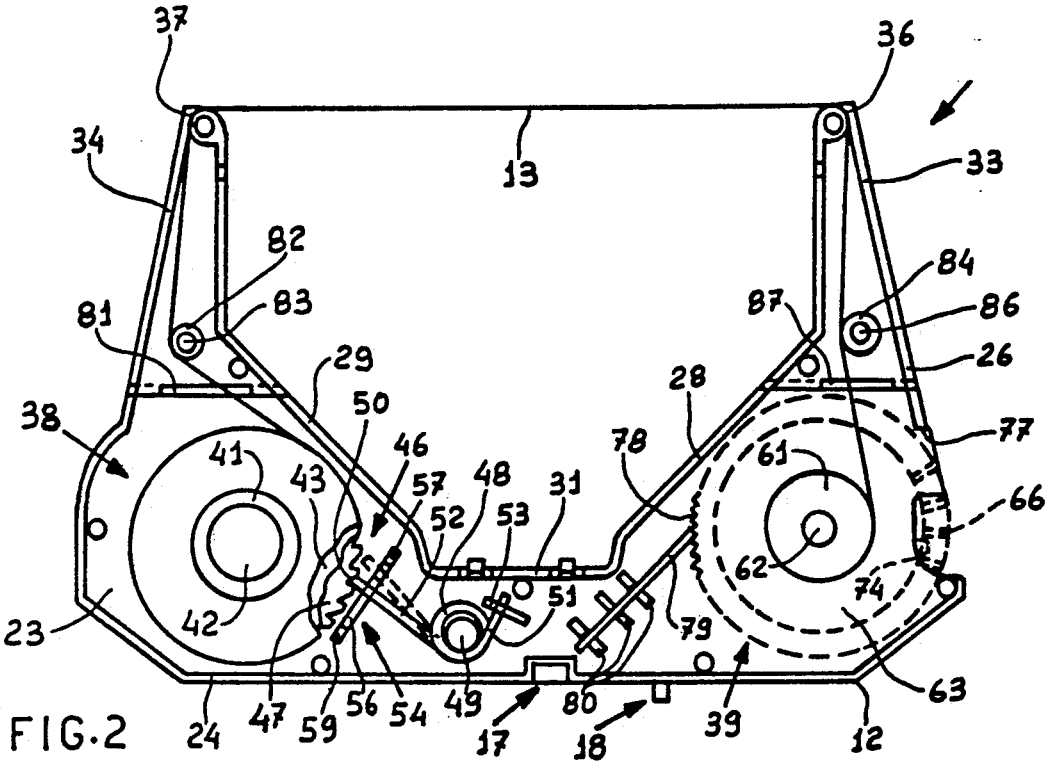
FIG. 2 is a plan view of part of the cartridge of FIG. 1, showing some features thereof, in an operating position.

Referring to FIGS. 1, 2, 4 and 5, a cartridge for a correction ribbon is generally identified by reference numeral 11 and comprises a container 12 for accommodating a correction ribbon 13 which can be of the lift-off cancellation type suited to a typing ribbon of single-strike correctable carbon type, or the cover-up correction type, suited to a typing ribbon of the non-correctable type with a support of polyethylene and of multi-strike type with a support of nylon and of the inked type with fabric support.

A cartridge for a typing ribbon is generally identified by reference numeral 14 and can accommodate a typing ribbon 16 which can be of single-strike correctable type or of non-correctable type of the various types of polyethylene, mylar and fabric. The correction cartridge 11 can be removably fixed on the lower part of the cartridge for the typing ribbon 14. The cartridge 14 for the typing ribbon 16 can be removably fixed on a support 19 of a typewriter either individually or in conjunction with the cartridge 11 for the correction ribbon 13. The cartridge 14 for the typing ribbon 16 has been described and illustrated in diagrammatic and highly simplified form in order not to complicate the description and drawings.

The cartridge 11 for a correction ribbon 13 is mounted on a typewriter, for example an electronic typewriter, having a conventional platen roller 21 which defines a point of typing 22. The support 19 is movable selectively in known manner, for example as described in U.S. Pat. No. 4,637,744, from a first viewing position in which the point of typing 22 is visible to a second typing position in which the typing ribbon 16 is in front of the point of typing 22, and to a third correction position in which the correction ribbon 13 is in front of the point of typing 22. Only the first and third positions are shown in the drawings.

The cartridge 11 comprises the container 12 of plastics material, having a bottom 23, a front wall 24, two right-hand and left-hand side walls 26 and 27 and two rear walls 28 and 29 which are connected by an intermediate wall 31 parallel to the front wall 24, and in addition it is closed upwardly by a cover 32. The container 12 comprises two arms 33 and 34 projecting from the rear walls 28 and 29 and having two openings 36 and 37 for respectively exposing to the exterior a straight part of the correction ribbon 13. The container 12 can accommodate a supply reel generally indicated at 38, on which the correction ribbon 13 is wound, and a receiving reel generally indicated at 39, on which the correction ribbon 13 is wound again after having been used for the correction of characters.

Figure 3:
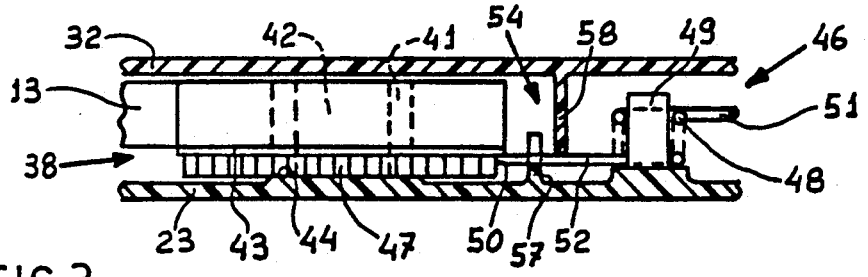
FIG. 3 is a front view of part of the cartridge shown in FIG. 1, illustrating some features thereof.
Figure 6:
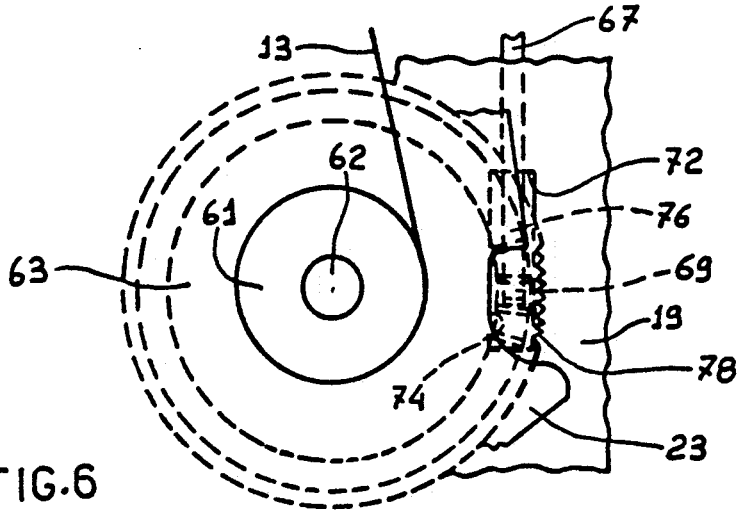
FIG. 6 is a plan view of part of the cartridge in FIG. 1, showing some features thereof, on an enlarged scale.

The supply reel 38 (FIGS. 1, 2 and 3) comprises a tubular portion 41 rotatable about a pin 42 of the container 12, and a flange 43. The reel 38 is supported by means of the tubular portion 41 on a projection 44 on the bottom 23. A tensioning device generally indicated by reference numeral 46 comprises a toothed ring 47 having a series of small peripheral teeth, in an integral construction, and fixed to the underside of the flange 43, and a spring element 48 which is pivoted in such a way as to be capable of oscillating movement on a fixed pin 49 on the bottom 23, and is provided with a yielding part having an end 50 engaged with a tooth of the toothed ring 47. By virtue of its engagement with the ring 47, the spring element 48 urges the supply reel 38 in a clockwise direction in such a way as to rewind the ribbon 13 and it is thus in opposition to any unwinding of the ribbon 13 both when the container 12 is removed and when it is mounted on the support 19 and the ribbon 13 is not being caused to advance. By acting during the unidirectional feed movement of the ribbon 13 in the correction cycles, it opposes the feed movement of the ribbon 13. In that case, as described hereinafter, the tension of the ribbon 13 causes the reel 38 to rotate in the anticlockwise direction and the resilient element 48 flexes until the end 50 thereof comes out of engagement with the tooth of the ring 47 and endeavours to return rapidly to the rest position. During that movement however it engages with another tooth of the toothed ring 47 and tries to cause the reel 38 to rotate in the opposite direction to unwinding of the ribbon 13 and therefore keeps the ribbon 13 in a tensioned condition.

The spring element 48 comprises a piano wire portion having a series of concentric turns pivoted on the fixed pin 49 and two arms 51 and 52. The first arm 51 bears against a fixed shoulder 53 on the container 12 and the second arm 52 defines the yielding part of the element 48 and the end 50 which is engaged with a tooth of the ring 47.

A guide element 54 is arranged to guide and hold the second arm 52 in coplanar relationship with the toothed ring 47. The guide element 54 comprises a groove 56 for accommodating and guiding the second arm 52 in the alternating movements thereof in order to hold it in constant engagement with the teeth of the ring 47. The guide element 54 may be formed by one portion projecting from the bottom 23 or the cover 32 and having the groove 56, or it may be formed by two portions 57 and 58 in which the first portion 57 projects from the bottom 23 and comprises the groove 56 while the second portion 58 projects from the cover 32 and defines the groove 56 in an upward direction. The two portions 57 and 58 are positioned adjacent to each other and permit only the alternating movements of the arm 52 of the spring 48, which however are coplanar with the toothed ring 47.

As a result of a character being struck for a correction operation, a portion of ribbon 13 can be unwound from the reel 38, which in certain cases causes the end 50 to be ridden over by one of the teeth of the toothed ring 47. The end 50 however engages the subsequent tooth and, the arm 52 causes the part of the ribbon 13 which was unwound as a result of the strike to be rewound on the reel 38. The working travel of the arm 52 is adequate for that purpose.

The guide element 54 is on the other hand delimited by a stop surface 59 which limits the operating travel of the arm 52. In the situation where, due to an irregular action on the ribbon 13 which is not followed by rewinding thereof, an amount of ribbon 13 is unwound from the reel 38, such as to cause the end 50 of the spring element 48 to pass over more than five teeth, subsequent rewinding of the ribbon 13 on to the reel 38 by means of the element 48 is limited to that amount and is concluded with the arm 52 coming to bear against the surface 59. The spring element 48 is tensioned in such a way that, when the arm 52 comes to bear against the surface 59, the end 50 performs a resilient stop action for the reel 38, which prevents any unwinding of the ribbon 13 which does not originate expressly from the ribbon 13 itself.

The receiving reel 39 (see FIGS. 1, 2, 6, 7 and 8) comprises a tubular portion 61 which is rotatable on a fixed pin 62 projecting from the bottom 23 and a flange 63 having a series of frontal teeth 66 provided in the lower part of the flange 63. A feed mechanism of the machine which is indicated generally at 64 comprises a ratchet formed by a lever 67 pivoted on a fixed pin 68 of the machine and having a tooth 69 capable of co-operating with the frontal teeth 66, and a spring element 71 which co-operates with the lever 67 to hold it in a position of being rotated towards the receiving reel 39 with the tooth 69 in a high position adjacent to a frontal tooth 66.

The support 19 of the machine comprises a groove 72 for accommodating and guiding the lever 67 and a shoulder 73 positioned adjacent the groove 72 and co-operable to arrest the lever 67 when the container 12 is removed from the support 19. The bottom 23 of the container 12 has an opening 74 which is aligned with some frontal teeth 66 and which is capable of permitting the tooth 69 to pass therethrough for engagement thereof with the teeth 66. The bottom 23 further comprises a shoulder 76 adjacent to the opening 74 and co-operable with the tooth 69 when the container 12 is mounted on the support 19 and the latter is in its third position.

The right-hand side wall 26 of the container 12 has an opening 77 contiguous with the opening 74 in the bottom 23 and is capable of accommodating the external part of the flange 63 of the receiving reel 39 to permit manual feed movement of the ribbon 13.

The flange 63 also has a series of small peripheral teeth 78 which are co-operable with the end of a spring stop element 79 of the container 12 to prevent reverse movement of the receiving reel 39 and to assist with the unidirectional manual feed movement of the correction ribbon 13. In particular the element 79 is formed by a spring steel blade having a part which is fixed in ribs 80 projecting from the bottom 23 of the container 12 and which is engaged by a co-operating rib 85 projecting from the cover 32. The parts 49, 51 and 80 are all disposed in a central part of the container 12 between the axes of the reels 38 and 39 to minimise the amount of space occupied.

The above-described cartridge 11 can accommodate indiscriminantly either a ribbon 13 of the lift-off cancellation type or of the cover-up correction type, and the mode of operation thereof is exactly the same. The correction ribbon 13 is unwound from the supply reel 38 and is guided in its lower part by a guide edge 81, it is guided around a roller 82 rotatable about a fixed pin 83 on the container 12 and issues from the container 12 by passing through the opening 37. The ribbon 13 subsequently passes back into the container 12 again by way of the opening 36, is guided around a roller 84 rotatable about a fixed pin 86 of the container 12, and is guided in its lower part by a guide edge 87 to be rewound on to the receiving reel 39.

If the cartridge 11 is removed from the support 19 the lever 67, due to the force of the resilient element 71, is caused to bear against the shoulder 73 of the support 19. When the cartridge 11 is mounted on the support 19, by positioning from above with respect to the support 19, the tooth 69 is displaced from its rest position and can engage either into a space between two contiguous teeth 66 or with a tooth 66, as shown by the dash-dotted lines in FIG. 7. In particular the lever 67 is rotated in a clockwise direction against the force of the spring element 71 and is thus disengaged from the shoulder 73. In the case in which the tooth 69 is engaged with a tooth 66, in the first correction cycle, when the support 19 moves from the first to the third position, the tooth 69 is also disengaged from the tooth 66 and is positioned in the space between the two teeth 66.

Figure 7:
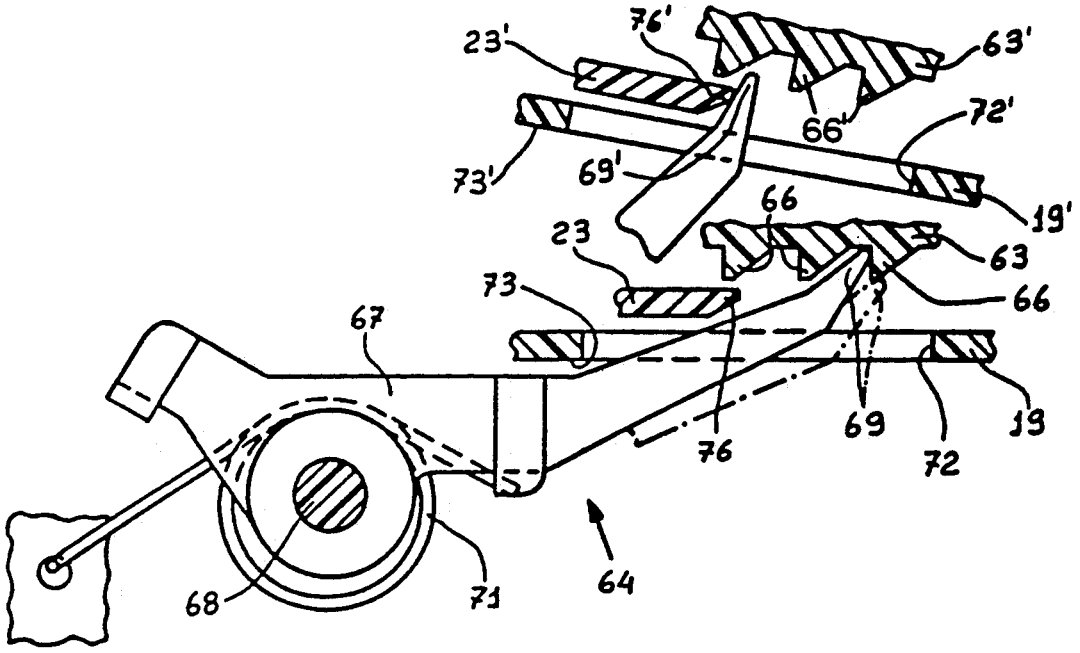
FIG. 7 is a side view of part of the structure shown in FIG. 6, illustrating some features thereof, in an operating position and on an enlarged scale.
Figure 8:
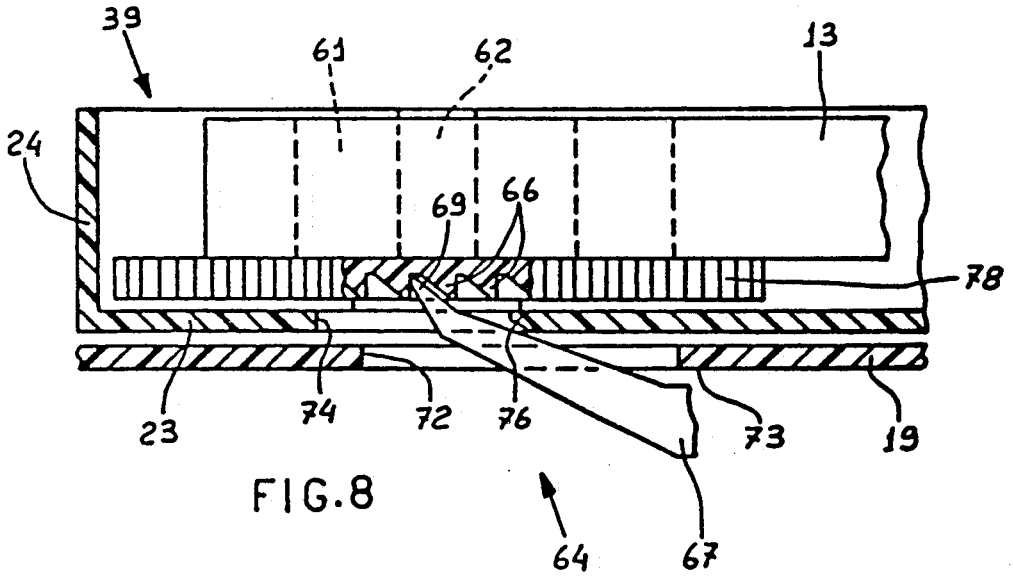
FIG. 8 is a side view of part of the cartridge of FIG. 1, illustrating some features thereof.

As described hereinbefore, due to the force of the spring element 71 the lever 67 is always stressed in an anticlockwise direction and therefore follows the movements of the support 19 when it is displaced from the first position to the second and third positions. For the sake of clarity and simplicity, FIG. 7 shows only the first position of the support 19, the tooth 69, a part of the bottom 23 with the shoulder 76 and a part of the flange 63 with the teeth 66 and the third position of the support 19', the tooth '69, a part of the bottom 23' with the shoulder 76' and a part of the flange 63' with the teeth 66'. The travel movement of the support 19 when it goes from the third position to the first position is such that the frontal tooth 66 is caused to engage with the tooth 69, causing the lever 67 to rotate in the clockwise direction against the force of the spring element 71. That causes a reciprocal movement as between the tooth 66 and the tooth 69 such that the tooth 69, by engaging the tooth 66, rotates the receiving reel 39 by a predetermined amount such as to optimize the forward feed movement of the correction ribbon 13. The travel movement of the support 19 from the second position to the first position however is insufficient to permit the tooth 69 to engage with the frontal tooth 66 to produce a feed movement of the correction ribbon 13.

It will be appreciated that modifications and improvements may be made in the cartridge 11 for the correction ribbon 13 both in regard to the form and the arrangement of the various elements and parts without thereby departing from the scope of the invention.

What we claim is:

1. A cartridge for a correction ribbon for typewriters, comprising a container accommodating a supply reel on which said correction ribbon is initially wound and a receiving reel on which said correction ribbon is rewound after having been used, said receiving reel co-operating with a feed mechanism of said typewriter to produce a unidirectional feed movement of said ribbon in each correction cycle and a tensioning device for said supply reel for tensioning said ribbon in opposition to said feed movement said feed mechanism, said tensioning device comprising a toothed ring having a series of peripheral teeth integral with said supply reel, and a spring element having a fixed part bearing against said container and a yielding part having an end engaged with said teeth of said toothed ring to urge said supply reel in a direction opposite to said feed movement of said correction ribbon for tensioning said ribbon, and in which said end of said spring element of being intermittently disengaged from said teeth during said feed movement of said ribbon and being held in engagement with one of said teeth for a given operating travel during which the end of said spring element applies said tensioning action to said supply reel.

2. A cartridge for a correction ribbon according to claim 1, wherein said spring element comprises a piano wire portion having first and second and a series of concentric turns between said arms pivoted on a fixed pin of said container in which the first arm defines said fixed part and bears against a shoulder on said container and in which the second arm defines the yielding part and the said end which is engaged with the toothed ring.

3. A cartridge according to claim 2, wherein said fixed pin is located in a position intermediate said ribbon supply and receiving reels.

4. A cartridge according to claim 1, wherein said receiving reel has a ring of fine teeth co-operating with an end of a spring stop element to prevent reverse movement of said receiving reel and in which said stop element has an intermediate portion fixed on said container.

5. A cartridge according to claim 3, wherein said receiving reel has a ring of fine teeth co-operating with an end of a spring stop element to prevent reverse movement of said receiving reel and in which said stop element has an intermediate portion fixed on said container and further wherein said intermediate portion of said stop element is fixed on said container adjacent to said said fixed pin.

6. A cartridge according to claim 1, wherein said container comprises a guide element for guiding said yielding part of said spring element and for holding said end in coplanar relationship with said teeth of said toothed ring.

7. A cartridge according to claim 2 wherein said container comprises a guide element for guiding said yielding part of said spring element and for holding said end in coplanar relationship with said teeth of said toothed ring and further wherein said guide element comprises a groove for accommodating and guiding said second arm in said alternating movements thereof to hold said end in engagement and disengagement relationship with said teeth of said toothed ring.

8. A cartridge according to claim 1, further comprising an end-of-travel element on said container such as to define a limit position in said working travel movement of said yielding part in which said end of said yielding part is held in a tensioned condition and in engagement with said toothed ring and in which said supply reel is held in a rest condition by a positioning action of said end against said teeth of said toothed ring.

9. A cartridge according to claim 7, further comprising an end-of-travel element on said container to define a limit position in said working travel movement of said yielding part, said end of said yielding part being held in a tensioned condition and in engagement with said toothed ring and in which said supply reel is held in a rest condition by a positioning action of said end against said teeth of said toothed ring and wherein said guide element comprises a rib structure on said container of said cartridge and in which said end-of-travel element is formed by a part of said rib structure.

10. A cartridge for a correction ribbon according to claim 1, wherein said supply reel comprises a flange and said toothed ring is integral with said lower part of the flange.

11. A cartridge for a correction ribbon for typewriters, comprising a container accommodating a supply reel on which said correction ribbon is initially wound and a receiving reel on which the correction ribbon is rewound after having been used, said container being removably fixed on a lower part of cartridge for a typing ribbon which in turn can be mounted on a support of said typewriter which is movable selectively from a viewing position, in which a point of typing is visible, to a typing position in which said typing ribbon is in front of said point of typing and a correction position in which said correction ribbon is in front of said point of typing, said receiving reel being actuated by a feed mechanism of said typewriter responsive to a displacement of said support about said correction position to produce unidirectional feed movement of said correction ribbon in each correction cycle, said cartridge for the correction ribbon comprising a series of frontal teeth provided in a lower part of a flange of said receiving reel and an opening in a bottom of said container in alignment with a given part of said series of frontal teeth and in which said cartridge for the correction ribbon can be used in machines in which said feed mechanism comprises a ratchet pivoted on a fixed support and having a terminal tooth capable of cooperating with said frontal teeth through said opening in said bottom of said container, and a spring element which applies a thrust force to said ratchet in a direction towards said flange, said thrust force being resisted by movement for mounting of said cartridge for the correction ribbon on said movable support of said typewriter.

12. A cartridge according to claim 11, wherein said container comprises a shoulder adjacent to said opening to cooperate with said ratchet when said support of said typewriter is in said correction position.

13. A cartridge according to claim 12, wherein the container comprises a side wall having an opening contiguous with said opening in said bottom and capable of accommodating an outside periphery of said flange to permit manual feed movement of said correction ribbon.

14. A cartridge according to claim 11, wherein said receiving reel has a ring of fine teeth capable of cooperating with an end of a spring stop element to prevent reverse motion of said receiving reel and in which said spring stop element has an intermediate portion fixed on said container.

15. A cartridge according to claim 13, wherein said receiving reel has a ring of fine teeth capable of cooperating with an end of a spring stop element to prevent reverse motion of said receiving reel and in which said spring stop element has an intermediate portion fixed on said container and further wherein said ring of fine teeth is disposed on said outside periphery of said flange to facilitate manual engagement of manual feed movement of said correction ribbon.

16. A cartridge according to claim 11, wherein the container can be used in a typewriter in which a travel movement of said movable support, when the container goes from said correction position to said viewing position, is such that said terminal tooth displaces a tooth of said series of frontal teeth, rotating said receiving reel by a predetermined amount such as to optimize said feed movement of said correction ribbon.

17. A cartridge according to claim 16, wherein the container can be used with a typewriter in which said terminal tooth due to said action of said spring element, follows said movements of said movable support from said viewing position to said typing and correction positions and in which said travel movement of said movable support for said viewing and typing positions is insufficient to permit engagement of said terminal tooth with said tooth of said series of frontal teeth to produce a feed movement of said correction ribbon.

18. A cartridge according to claim 16, wherein the container can be used in a typewriter in which said movable support comprises a groove for accommodating and guiding said ratchet and in which said movable support further comprises a shoulder adjacent to said groove cooperate with said ratchet when said container is removed from said movable support.

* * * * *